US005867975A

United States Patent [19]

Breitenhuber et al.

[11] Patent Number: 5,867,975

[45] Date of Patent: Feb. 9, 1999

[54] APPARATUS FOR THE INITIATION OF SPINNING A THREAD ON AN OPEN-END SPINNING APPARATUS

[75] Inventors: Josef Breitenhuber, Buxheim; Anton Furtmeier, Neustadt/Donau; Adam Gensberger, Bergheim, all of Germany

[73] Assignee: Rieter Ingolstadt Spinnereimaschinenbau AG, Ingolstadt, Germany

[21] Appl. No.: 940,872

[22] Filed: Sep. 30, 1997

[30] Foreign Application Priority Data

Oct. 16, 1996 [DE] Germany ..... 196 42 670.7

[51] Int. Cl.[6] ..... D01H 4/00

[52] U.S. Cl. ..... 57/413; 57/263; 57/407; 57/408; 57/411

[58] Field of Search ..... 57/263, 407, 408, 57/411, 413, 415, 301

[56] References Cited

U.S. PATENT DOCUMENTS

| | | | |
|---|---|---|---|
| 4,676,059 | 6/1987 | Artzt et al. . | |
| 5,065,572 | 11/1991 | Stahlecker | 57/408 |
| 5,095,689 | 3/1992 | Ferro et al. | 57/263 |
| 5,109,663 | 5/1992 | Stahlecker et al. | 57/411 |
| 5,367,867 | 11/1994 | Lovas | 57/411 |
| 5,456,073 | 10/1995 | Thierron et al. | 57/263 |
| 5,463,860 | 11/1995 | Sauer | 57/263 |
| 5,535,580 | 7/1996 | Sebastain et al. | 57/263 |

FOREIGN PATENT DOCUMENTS 8601235 2/1986 WIPO .

OTHER PUBLICATIONS

German Search Report, Dec. 30, 1996.

*Primary Examiner*—William Stryjewski
*Attorney, Agent, or Firm*—Dority & Manning

[57] ABSTRACT

The present invention concerns an apparatus, in particular a cover for a rotor (51), for the initiation of the spinning of a thread in an open-end spinning apparatus (1), which apparatus possesses a fiber feed conduit (6) which extends from a disintegrating apparatus (4) to a spin rotor (50), which is installed in a rotor housing (5) in combination with a controllable vacuum source, and which rotor (50) is covered with a rotor cover (51) which also accepts the fiber feed conduit (6), at least partially. The apparatus exhibits further a service wagon (2) for the open-end spinning apparatus (1), which wagon carries a suction line (20) to a connection piece (7) of the open-end spinning apparatus (1). The connection piece (7) is in communication with a connection opening (70) in the fiber feed conduit (6) and is in a break-away sealed connection with the rotor cover (51). The connection opening (70) is surrounded by a surface (700) for contact to a sealing element (731) which is integral with the connection piece (7).

23 Claims, 3 Drawing Sheets

APPARATUS FOR THE INITIATION OF SPINNING A THREAD ON AN OPEN-END SPINNING APPARATUS

BACKGROUND OF THE INVENTION

The present invention is concerned with an apparatus for the initiation of spinning a thread on an open-end spinning apparatus and with an appropriate rotor cover therefor.

It is common knowledge, during the initial stages of spinning, to release the fiber band feed to the opening roll, to divert and lead the fibers away from the conventionally followed operational path during the normal spinning procedure, and to do so before said fibers reach the spin rotor. The fibers are only brought back to the spin rotor at an appropriate time. This is done so that, for the initiation of spinning fibers onto a thread end which has been introduced into the spin rotor, the fibers find more faultless conditions for incorporating themselves into a thread in the said spin rotor (WO 86/01235).

For this purpose, there is provided in an encapsulating wall of the housing which contains the opening roll, a suction opening, located in the fiber transport direction toward the opening of the fiber feed conduit. To this said opening, a connection piece is sealingly joined. A suction line can be added to this connection piece by, for example, being brought to the location of connection by a service unit.

The spin rotor is, as a rule, covered with an enclosure. For the maintenance of the open-end spinning apparatus, this enclosure must be swung away, so that, in turn, the spin cover can be opened, thus making the spin rotor accessible. The connection piece must give clearance to the swinging radius of the rotor cover. To this purpose, the connection piece has such a type of break-away sealing with an enclosure fitting, that upon pivoting the enclosure away, said connection piece is lifted from the said suction line.

When the enclosure is again swung back into its operational position, the connection piece is brought again into a tight sealed contact on the suction opening.

Evidence, however, has surfaced, indicating that the suction opening in the enclosure wall of the housing which encapsulates the opening roll, promotes wall deposition of fiber. If this occurs, upon the release of a fiber stream into the spin rotor system, these lump forming fibers carry through and get into the spin rotor where they interfere with the orderly initiation of spinning, that is, obstruct the spinning of a thread. In addition to this, there is the danger that fibers in the narrow zone between suction opening and the connection piece adhere to the walls in a hard deposition. This leads to a break in the sealed security and damage to the sealing means already in place. This impairs the functional and operational ability of the equipment. Beyond the danger that such disturbances are possible, the conventional apparatus is complex in construction and consequently expensive in cost and space.

OBJECTS AND SUMMARY OF THE INVENTION

Thus, it is a purpose of the present invention to achieve a system wherein construction and manufacture is simpler. Moreover, the system will also reduce the danger that fibers agglomerate and later cause difficulties.

The purposes will be achieved in accord with the present invention. By means of the union of the connection piece with a provided connection opening in the rotor cover, the connection piece is releasably affixed to an element which, like itself, can be moved to provide access to the open-end spinning apparatus. Thereby, a relative movement between the connection piece and rotor cover is not required.

Consequently too, the problems cited above of a "release and restore" segment disappear. Since there are no parts which must be relatively movable, in relation to other moving parts, the design can be simpler and thus cost and space demand take on a more favorable aspect.

Advantageously, the connection piece is integral with the movable parts, and is in a break-away sealed connection not only with the rotor cover, but also with a flap entry equipped enclosure which encompasses the open-end spinning device and detachably carries the rotor cover.

A design wherein the connection piece is carried on both its ends by said enclosure and is united with the rotor cover by means of a sealing element makes possible, in a case of need, a simple replacement of the rotor cover, without the necessity of being required to simultaneously change the connection piece or to mechanically disengage it.

A particularly favorable design of the apparatus in accord with the invention is wherein the sealing element is borne by the enclosure through the interposed retaining plate which is affixed to the enclosure for the rotor cover.

An embodiment wherein the sealing element, which circumferentially sheathes the end of the connection piece in proximity to the rotor cover, sealingly abuts a surrounding surface of the connection opening with that end thereof which is in proximity to said rotor cover assures that any tolerances are balanced out in a simple manner.

Through the choice of the relative measurements, wherein the entry aperture of the end of the connection piece in proximity to the feed conduit exhibits an inside cross-section which is greater than the facing inside cross-section of the connection opening, the deposition of fibers in the transition passage between the opening for the connection and the connection piece has been avoided.

In an embodiment wherein the sealing element is bound to the rotor cover by means of a breaking seal securement that is an integral component of the retaining plate, which plate carries the rotor cover, an additional simplification of the design and exchangeability of the inventive elements has been achieved.

By having the connection piece continually narrow in the direction of the fiber feed conduit, in the area of the joining of the connection opening in the fiber feed conduit, a concentrated and intensive air stream is brought about, which assures a faultless turn-around and exit of the fibers.

In order to make certain that even single fibers, which under certain circumstances could be entrained and pass by the connection opening, are returned to this opening and thus conducted away, advantageously, a shaping of the apparatus wherein the fiber feed conduit narrows in the direction toward the spin rotor and the connection aperture opens near the greatest cross-sectional opening of said fiber feed conduit has been provided.

An embodiment wherein the connection opening forms an acute angle (a) with the fiber feed conduit in the direction of the fiber feed transport or exhibits a non-circular cross section in the discharge area of the fiber feed conduit and the greatest width (w) of said cross section extends at right angles to the fiber feed transport direction opposes a deposition of fiber at the connection opening.

By the design of the apparatus in accord with the invention wherein the connection opening into the fiber feed conduit and the connection piece, as well as the vacuum line connected to said piece, form a mutual flow path, the situation arises that in the connection opening an unthrottled, active air flow is brought about upon change of direction, while an inventive construction of the apparatus wherein the connection opening and the connection piece are installed essentially parallel to axis (A) of the spin rotor serves for a simplification of the design.

In accordance with the purposes of the invention, a rotor cover is provided which at least partially encompasses a fiber feed conduit, which conduit extends itself out from an opening roll to a spin rotor entry, whereby the open-end spinning apparatus possesses a connection piece, which can be attached to a vacuum line, therein characterized, in that in the immediate proximity of the outer surface of the rotor cover a connection opening opens for the attachment of connection piece.

With the help of a rotor cover embodiment wherein the connection opening is surrounded by a flat surface for a sealing element affixed to the connection piece, any possible tolerances are balanced out in a simple manner.

Construction of the rotor cover wherein the rotor cover possesses in a first plane (I) a contact surfaces for its affixing to a retaining plate which is carried by the enclosure, and further possesses a second, parallel plane (II) on which is found the surface surrounding the connection opening, and said plane II is disposed at a greater distance from the contacting position of the side against the rotor housing and the contact surface, which is found in a first plane (I), of the rotor cover is formed by the front surfaces of the spacer pieces, which said spacer pieces are integral components of the rotor cover, the prerequisite for an especially simple and advantageous design of the apparatus in accord with the invention is provided.

In an embodiment of the rotor cover wherein the connection opening joins with the fiber feed conduit counter to the fiber transport direction in an acute angle (a) or the connection opening in the discharge zone in the fiber feed conduit exhibits a non-circular cross-section, the greatest width whereof runs at right angles to the fiber transport direction, a plugging at the connection opening is prevented.

By design of the apparatus wherein, an installed fiber feed conduit in said rotor cover is characterized, and the connection opening is essentially parallely arranged to the thread filament exit duct, the achievement will be that in the connection opening, an efficient unthrottled air flow is effected by change of direction.

The invention is simple in design and increases the assurance of functional reliability. By this means, also, the object of the invention is such that existing open-end spinning apparatuses can be refit therewith. The refitting can be done along a multiplicity of spinning points without the necessity for related changes on the mobile service wagon.

Embodiment examples of the invention are presented in the following in more detail with the aid of drawings.

DETAILED DESCRIPTION OF THE PREFERRED EMBODIMENTS

Figure 1:
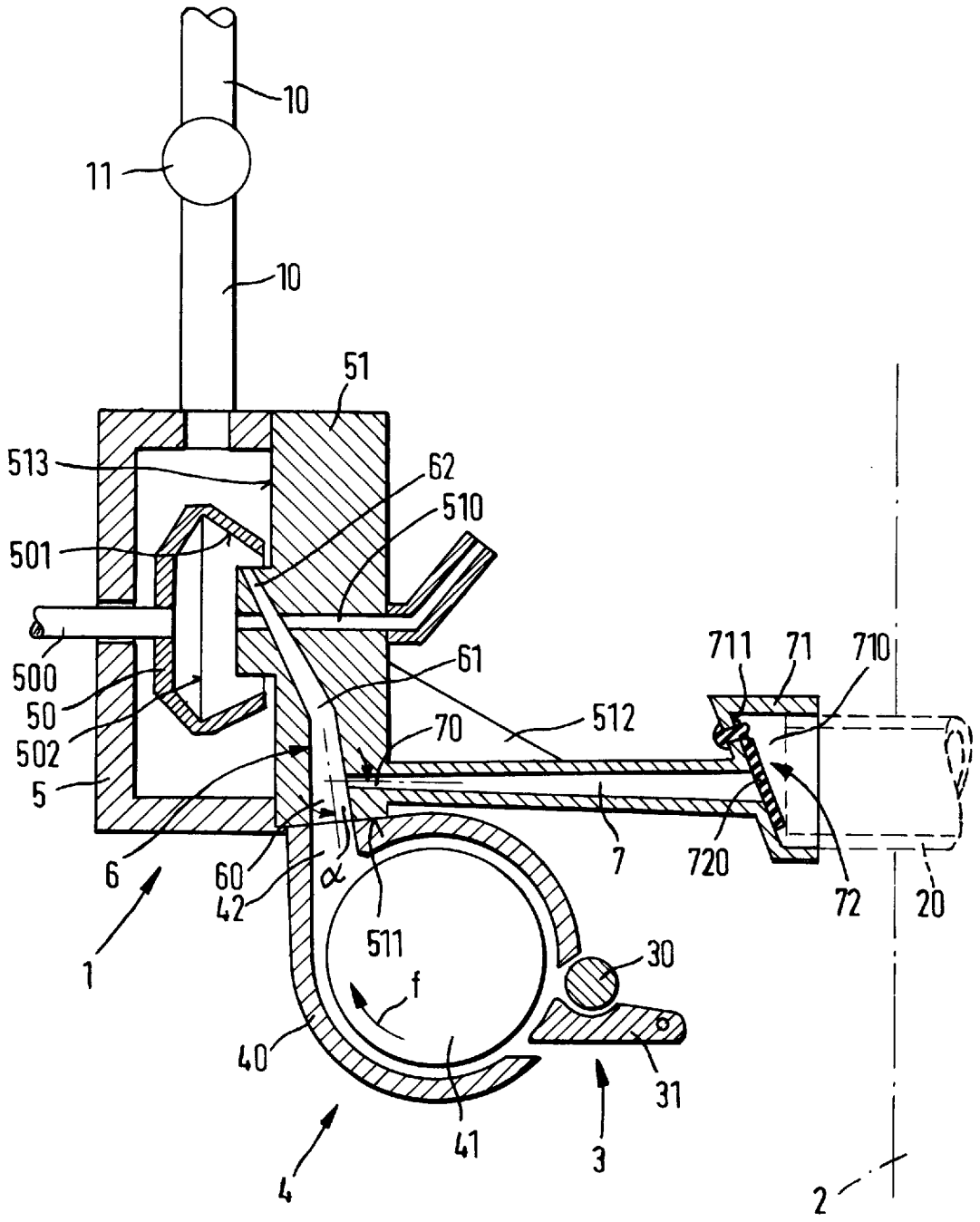
FIG. 1 is an open-end spinning apparatus in accord with the invention in schematic section.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. It is intended that the present invention include such modifications and variations.

In the interest of a comprehensive overview, in FIG. 1 there is shown essentially each element of an open-end spinning apparatus 1, as well as a service unit 2, which are necessary for an understanding of the invention. It goes without saying, that both the open-end spinning apparatus 1 and the service unit 2, besides the indicated elements, are also equipped with components necessary to their usual applications.

The open-end spinning apparatus 1 exhibits in conventional manner a feeding mechanism 3, a fiber opening apparatus 4, and a rotor housing 5 for the acceptance of a spin rotor 50.

The feed mechanism 3 shows in the illustrated version, a feed roll 30 as well as a charging receptor 31, which receptor is conventionally supported and, with the aid of a not shown means, is pressed elastically in the direction of the feeding roll 30.

The fiber opening apparatus 4 possesses a housing 40 in which, in non-illustrated fittings, an opening roll 41 is placed. In an essentially tangential fiber transport direction (arrow f), an exit opening 42 is provided onto which, the entry opening 60 of the main part 61 of a fiber feed conduit 6 is attached. The fiber feed conduit 6 joins with its exit opening 62 opposite from the inner, circumferential wall 501 in the spin rotor 50. The main part of the fiber feed conduit 6 is installed in a rotor cover 51, which, in its operational position, lies with a facing side on the rotor housing 5, thereby closing this and covering the open side of the spin rotor.

On the side remote from the rotor cover 51, the spin rotor possesses a shaft 500 which extends itself through an opening in the base of the rotor housing 5 in conventional sealed manner and with the aid of this, the spin rotor is set normally in bearings and driven.

In conventional manner, the rotor housing 5 is connected to a source of low pressure which is not shown. In order to be able to control the low pressure in the spin rotor 50, a valve 11 is placed in the line 10, which valve 11 can be controlled in an appropriate manner by a control means (which is not shown).

Central to the spin rotor 50, that is, coaxial to the axis A of the spin rotor 50, is located a thread removal duct 510, which opens into the rotor housing 5. A thread generated in the spin rotor 50 (thread not shown) can be withdrawn through this duct 510, so that it can be wound upon a spool (also not shown).

In immediate proximity of the side 511 of the rotor cover 51 which faces the housing 40 of the fiber opening apparatus 4, a connection opening 70 for a connection piece 7 opens in the main part 61 of the fiber feed conduit, to which the end 71, which faces away from the open-end spinning apparatus 1, a suction line 20 can be attached. This suction line 20, is located on the said service unit 2, which is mobile and runs along a plurality of identically constructed open-end spinning apparatuses 1. The unit 2 makes stops for service and maintenance on the respective open-end spinning apparatus which requires such attention.

The end 71 of the connection piece 7 possesses, in the illustrated embodiment, a chamber 710 which accepts the intermittent insertion of the suction line 20 brought in on the service unit 2 to bring suction to the connection piece 7. Moreover, in the embodiment illustrated, in said chamber 710 is found a valve 72, which has the purpose, when suction line 20 is applied, to enable the under pressure existing in the suction line 20 to act in the interior of the fiber feed conduit 6. When the suction line 20 is removed, the entrance of ambient air around the open-end spinning apparatus is prevented from coming into the fiber feed conduit. In the illustrated embodiment, for this purpose, the valve 72 has an elastic flap 720 which, in accordance with the state of the under pressure, either sealingly lies on the chamber base 711 which is machined as a seating surface, or it is lifted therefrom. The valve 72 can also be a sphere, which makes closure with the connection piece 7, which is to say, the fiber feed conduit. In such an application, the sphere, by means of a spring or an inclined rolling surface, can be held in the closed position and direct or indirectly be opened by the suction line 20.

In the case of the embodiment in FIG. 1, the connection piece 7 is an integral component of the rotor cover 51, on which account, for the purpose of increasing the stability, a tie element 511 between the rotor cover 51 and the connection piece 7 is provided.

During undisturbed spinning procedures, the apparatus designed as described above, operates in a conventional manner. A continuous fiber band (not shown) is fed with the help of the feed device 3 to the opening apparatus 4, wherein the opening roll 41 reduces the fiber band to air borne single fibers, which leave the housing 40 because of the low pressure flow through the exit opening 42 , which is induced by line 10 through valve 11. The fibers proceed to the fiber feed conduit 6, from which they are ejected to impact the inner circumferential wall 501 of the spin rotor 50. The fibers slide from there into the collection groovings 502 of the spin rotor 50. At this location, they are bound into the end of a thread (not shown) which leaves the spin rotor 50 through the thread exit duct 510. From thence, in conventional manner, the threads are conducted to a spool arrangement for winding.

During normal spinning operation the flap 720 lies on the chamber base 711 because of the low pressure produced through the line 10 in the fiber feed conduit 6, so that no air can be pulled into the said fiber feed conduit 6 through the connection opening 70.

If a break occurs in the thread being pulled out of the spin rotor 50, then the spinning process is interrupted by the stopping of the feed mechanism 3 as well as the spin rotor 50. Later, the initiating spinning steps must be carried through again and the thread reinserted. The service unit 2, which comes to the troubled, open-end spinning apparatus 1 by patrolling or is called there by an impulse emitted by the thread break, stops at the open-end spinning apparatus 1. Now the initiating spinning procedure is carried out. The end of the starting thread to be reinserted in the open-end spinning apparatus is prepared in a known and customary manner and is brought into the thread exit duct 510 during a standby operation.

During the above preparations for the spinning initiation, the suction line 20 of the service unit 2 is presented to the end 71 of the connection piece 7 and within the suction line 20, a low pressure flow in the direction of the service wagon 2 is established. Because of the low pressure induced by the service wagon 2, the flap 720 of the valve 72 lifts itself from the base of the chamber 711, so that the low pressure now acts within the fiber feed conduit 6. Further, by means of shutting the valve 11, the low pressure in the line 10, and hence also in the rotor housing 5 and in the thread removal duct 6 is shut off from that source.

Now, by means of the reactivation of the previously stopped feed mechanism 3, the feed of the fiber band to the opening apparatus 4 starts again. Because of the active air flow in the connection piece 7, which exits the fiber feed conduit 6 in the direction of the service unit 2, the fibers are thereby prevented from reaching the spin rotor 50. Instead of this, they are diverted by the air flow to the service unit 2 and collected at an appropriate location.

In the usual way, then in a sequential, coordinated manner, the spin rotor 50 is again started up and accelerated, a thread end is redelivered to the collection grooving 502 of the spin rotor 50 and the fiber flow is again directed into the spin rotor 50 by means of shutting off the low pressure in the service wagon 2 and reopening the valve 11. In a timely, coordinated way, the extraction of the thread from the spin rotor 50 is again begun, and the normal spinning conditions are again established.

For the exchange of a spin rotor 50 in favor of a spin rotor of another shape or size, for instance, for handling of another fiber material, for the production of thread of different characteristics, or again for other maintenance work on the open-end spinning apparatus 1, it is required that the rotor cover 51 be removed from the rotor housing 5. In FIG. 1, the connection piece 7 is an integrated component of the rotor cover 51 and is necessarily bound to this, so that the rotor cover 51 and the connection piece 7 are always moved in unison.

Since the connection opening 70 opens laterally into the fiber feed conduit 6, the fibers have no opportunity, during normal spinning operation, to leave their direction of entrained flight along the fiber feed conduit 6 and to migrate into the connection opening 70. At this location, not even fine fibers can sift in, especially following a change of flow direction of the fibers during an initial startup procedure. This becomes important upon the redirection of the fiber flow when such accumulations could, in the form of small fiber lumps, enter the spin rotor 50. The results of avoiding such intrusion into the spin rotor 50 is not only for obtaining clean and uniformly shaped thread ends for fiber attachment, but also, so that no undesirable thread thicknesses from fiber lumps incorporated in said attachments will arise. The danger of failure upon spinning initiation or of thread breakage is no longer present, which can otherwise occur through fiber agglomeration at the beginning of a fiber change of direction or diversion, as in the case of an apparatus of the described conventional kind.

Within the framework of the present invention, the described apparatus can be altered in various ways, for instance, by means of the exchange of individual features by their equivalents or through other combinations of such kind.

Thus it is not requisite, that the rotor cover 51 and the connection piece 7 be constructed in one piece, as long as they are connectable, one with the other, in a break-away sealing manner. An embodiment of the described apparatus which is altered in this manner will be described in the following, with the aid of FIG. 2, which shows the preferred design.

Figure 2:
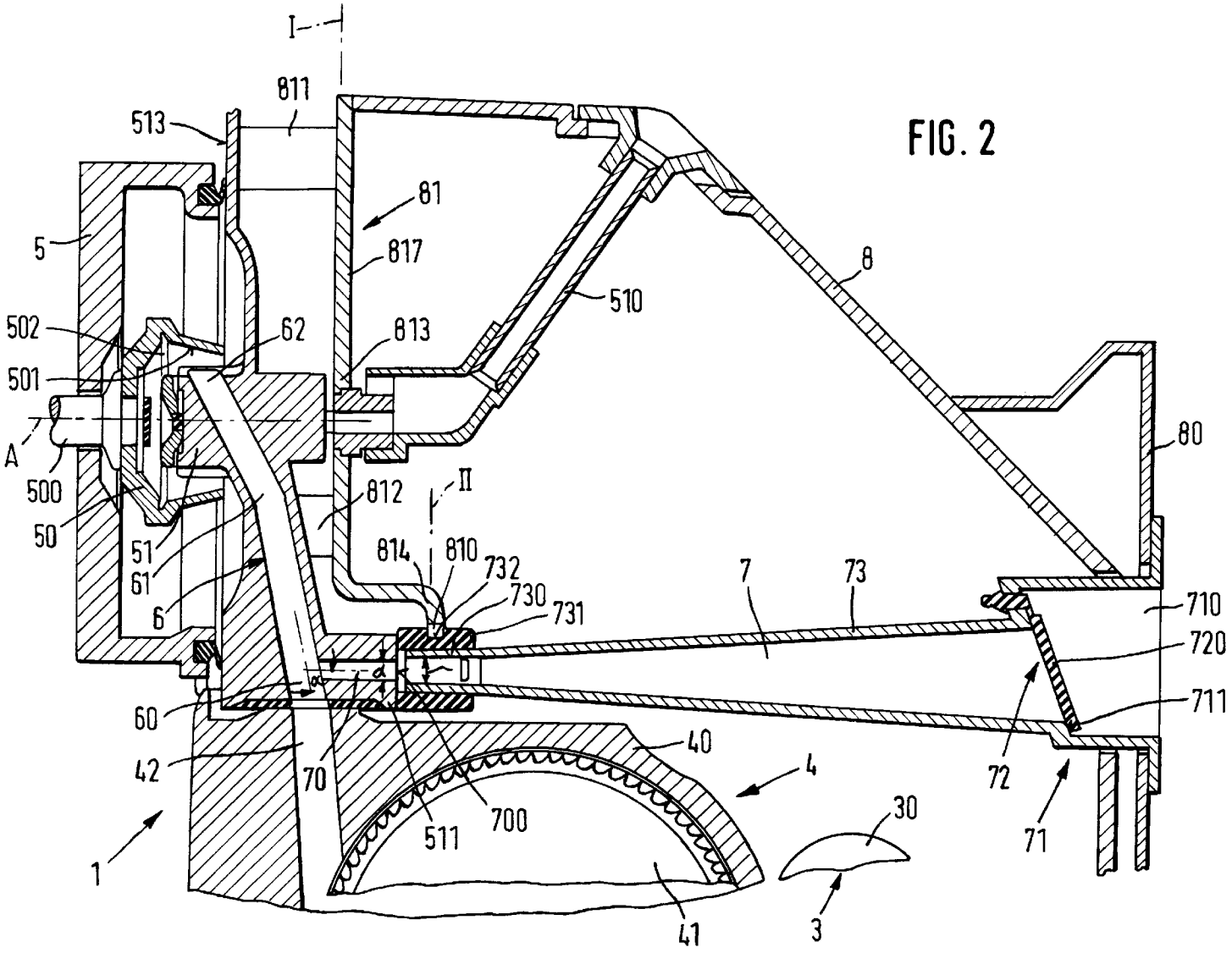
FIG. 2 is a preferred embodiment of an open-end spinning apparatus in sectional view.

In the case of the embodiment depicted in FIG. 2, the open-end spinning apparatus 1 is covered in conventional manner by a pivoting enclosure by means of which, the relevant parts of the open-end spinning apparatus 1 are optionally protected, that is, they may still be made accessible for maintenance. The enclosure 8 carries the end 71 of the connection piece 7, which is that end remote from the fiber feed conduit 6. For instance, the end 71 of the connection piece 7 may be screwed to the enclosure 8, especially, with the interposing of a shield 80.

The rotor cover 51 and the connection piece 7 form two separate entities. The rotor cover 51 includes the said connection opening 70 while the connection piece 7 is accommodated in a tubular section 73, one end 730 of which faces the rotor cover 51 and abuts on a surface 700 by means of sheath shaped sealing element 731. The said sealing element 731 peripherally encompasses that said end 730 of the tubular section 73 which meets the connection opening 70 and is pushed onto that end 730. The said sealing element 731 exhibits a peripheral groove 732, which facilitates the pushing of the sheathlike sealing element 731 into a slot 810 of a retaining plate 81. This slot 810 is so dimensioned, that, without further accessories, it is capable of imperviously securing the elastic sealing element 731. Thus, the tubular section 73 which comprises connection piece 7 makes a break-away seal on both ends with the enclosure 8.

The retaining plate 81 is affixed to the enclosure 8 and serves as a carrier for the rotor cover 51, so that the rotor cover 51 follows each movement of the pivotably installed enclosure 8. By means of this retaining plate 81, the tubular section 73 is thereby also bound to the rotor cover 51 with a movement permissive sealant. For this connection of the rotor cover 51 with the retainer plate 81, spacer elements 811, 812 are provided, which, for example can be integral parts of the rotor cover 51 or of the retaining plate 81.

The said retaining plate 81 exhibits an opening 813 for the thread removal duct 510, the end of which, remote from the rotor cover 51, is carried by the enclosure 8.

In order to be able to hold the spacer elements 812, 813 as small as possible, so that the position of the rotor cover 51 with respect to the rotor housing 5, and accordingly to the spin rotor 50, can be determined as exactly as possible, provision has been made that the retaining plate 81 is profiled in such a way that plate section 814 of the retaining plate 81 carrying the sealing element 731 is in a parallel plane II to that plane I, in which the rotor cover 51 carrying section 817 of the retaining plate 81 is found.

The fashion of the securement of the sealing means 731 on the enclosure 8, that is to say, on the retaining plate 81 carried by the enclosure 8, can be carried out in different ways. For instance, the sealing element 731 can be installed in an opening (not shown), possibly with the help of a pivot yoke or the like. The above described, break-away sealing method of the sealing means 731 with the help of a slit 810 which accepts said sealing means 731 is especially advantageous, since the removal of the sealing means 731 from its securement, and therewith also a removal of the tubular element 73 is particularly simple. The break-away sealing means can be optionally an integrated component of the enclosure 8 or of one of the elements carried thereon, for instance the retaining plate 81.

Also, when an enclosure 8 is provided, the connection piece 7 can be designed as an integrated component of the rotor cover 51. In this case, the end of the connection piece 7 in proximity to the rotor cover 51 affixed, directly or indirectly, to the enclosure 8 in appropriate manner, for instance in accord with the embodiment in FIG. 2 by means of a threaded engagement or a break-away seal.

FIG. 2 shows plainly, that in the case of this embodiment (which also holds true for FIG. 1) the fiber feed conduit 6 with the opening direction of the connection piece 7 encloses an acute angle in reference to the fiber transport direction. By means of this acute angle a, there can be added to the already cited features, that during the normal spinning process, no fibers can get into the connection opening 70, which can lead in any way to disturbances.

The tubular element 73 with the connection piece 7 possesses a narrowing cross-section from the end 71 in the direction of the fiber feed conduit 6. With such narrowing, the connection piece 7 has, when so released, low pressure air flowing through at maximum velocity in the area of the opening 70 of the connection piece 7 into the fiber feed conduit 6. This situation assures that when line 10 is blocked by valve 11 and low pressure flow is freely released through connection piece 7 by suction line 20, entrained fiber particles are prevented from flying past the connection opening 70. Rather than this undesired effect, the fibers are forced through the opening 70, into the connection piece 7 and from there through the suction line 20 and go into the service unit 2. Should, by the most unfavorable chance, a fiber succeed in flying by the opening 70, then by means of the air flow coming in through the fiber removal duct 510, which flow continues into the spin rotor 50 and on into the fiber feed conduit 6 into the connection piece 7, the said fiber would be compelled to turn about. Thus the fiber is prevented from reaching the internals of the rotor.

In order to exclude with certainty any wall deposition by fibers in the section between the connection opening 70 and the connection piece 7 in accord with FIG. 2, provision has been made such that the entrance opening of the end of the connection piece 7 in proximity to the fiber feed conduit 6 exhibits an internal cross-section opening D which is greater than cross section d of the facing connection opening 70. In this way, the shape of the inner cross-sections, D and d (circular or non-circular) plays no role.

As the FIGS. 1, 2 plainly show, the connection opening 70 which opens into the fiber feed conduit 6, the connection piece 7 and also the suction line 20 which is connected to said connection piece 7 and brought in by the service unit 2, forms a continuous, communicating flow channel, so that the low pressure applied through the suction line 20 to the connection opening 70 exerts suction on the fiber feed conduit 6 with the least possible loss in vacuum and produces a strong air stream for the diversion of the fibers.

Arising from practical grounds and for the achievement of the said acute angle a, between the fiber feed conduit 6 on the one hand and the connection opening 70 at connection piece 7 on the other, in accord with FIG. 2 the connection opening 70 and the connection piece 7, arranged in their connective extension, are installed essentially parallel to axis A of the spin rotor 50.

The core piece of the described apparatus is formed by the rotor cover 51, which is to be thereto correspondingly designed. Because of this, its construction will be once again described in the following.

Figure 3:
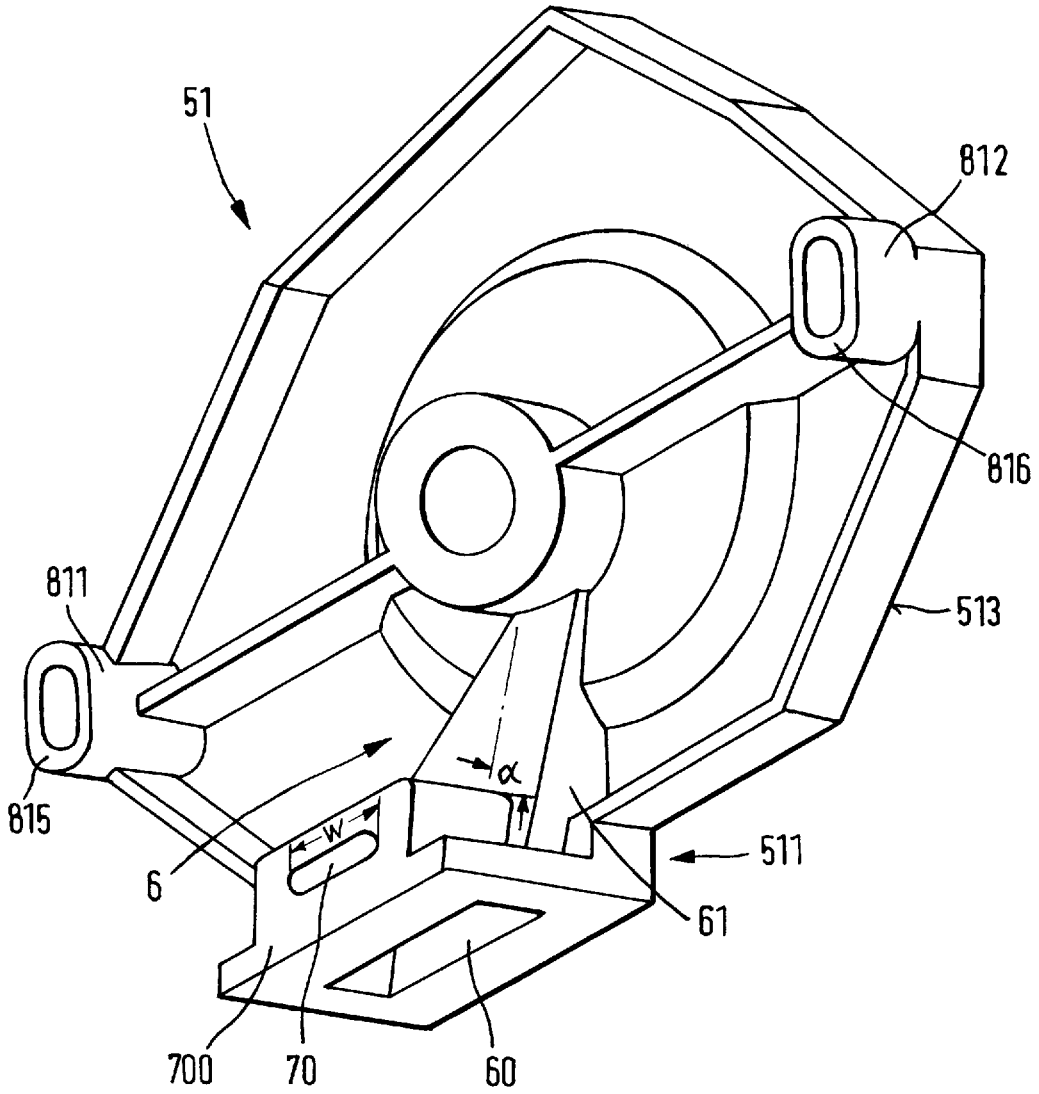
FIG. 3 is a rotor cover, in accord with the invention, in a perspective view.

The rotor cover 51 is shown in FIG. 3 in perspective view from the side away from the spin rotor 50. Below, in the illustration, one recognizes the entrance opening 60 in the main part 61 of the fiber feed conduit 6, which narrows itself from this entry opening in the direction of the exit opening 62 (see FIGS. 1, 2). This narrowing is to enable the delivering of a bundled fiber flow to the inner circumferential wall 501 of the spin rotor 50. In the area of the edge 511 of the rotor cover 51, the fiber feed conduit 6 exhibits a substantially larger inner cross-section, so that the velocity of the fiber flow will be considerably slower here than as in the exit opening 62 of the fiber conduit 6. By this means, the fiber stream, which has come through the entrance opening 60 into the main part 61 of the of the fiber feed conduit 6, is permitted without further hindrance, to be diverted and turned into the opening 70 in an active low pressure flow away from the usual straight through passage. The connection opening 70 is found in immediate proximity to the edge 511 of the rotor cover 51 and—in the case of the illustrated embodiment with a narrowing main section 61 of the fiber feed conduit 6—in the area of the greatest cross-section of this main portion 61 of the fiber feed conduit 6.

An essential goal, which is attained by the described apparatus, is that there is no point at which fibers can collect, where they can suddenly loosen and enter into the spin rotor 50 as fiber lumps or as fiber aggregates. This would lead to a disturbance in the initiation of spinning or in the spinning itself, even coming to a break in the thread. Various features serve this goal, usable individually or together. For one, the fact alone that the connection opening 70 is found in the side wall of the fiber feed conduit assures that the fibers, during normal spinning procedure, cannot settle out at that point.

By designing the angle a, between the longitudinal axis of the fiber feed conduit 6 and the longitudinal axis of the connection piece 7, as seen against the fiber transport direction, as an acute angle, this effect is additionally supported. A further measure in this direction, is the shaping of the connection opening 70. As plainly recognizable in FIG. 3, the connection opening 70 does not possess a circular cross section.

Rather, it is not round and has an elongated cross section, whereby the greater width w extends itself at right angles to the fiber transport direction (the transport direction being along the direction of the fiber feed conduit 6).

The connection opening 70 in the embodiment depicted in FIG. 3, which shows the installed position of the rotor cover 51, is oriented essentially parallel to the thread removal duct 510 which is coaxial to the axis A of the spin rotor 50. This design offers practical advantages (see above). The connection opening 70, on its side in proximity to the fiber feed conduit 6, is surrounded by a surface 700, which is machined fully plane and on which will abut the sheath like sealing element 731 (FIG. 2), which encompasses the tubular element 73, or another type of sealing means for said element 73.

In the case of the illustrated embodiment, in accord with FIG. 3, the two spacer elements 811 and 812 are integral parts of the rotor cover 51. The sides of said spacer elements 811 and 812 which face away from the rotor housing 5, namely sides 815 and 816 find themselves in a common plane I (see FIG. 2) and which, in the assembled arrangement of the rotor cover 51, abut the retaining plate 81 of the enclosure 8. Parallel to the first plane I, at a greater separating distance from the side 513 of the rotor cover 51, which faces toward the rotor housing 5, there is found in a parallel plane II, the mentioned sealing surface 700 for the interaction with sealing element 731 of the tubular element 73 which contains the collection piece 7.

It is, naturally, also possible, to reverse the geometric relationships. If this is done, instead of the sheath type sealing element 731 in accord with FIG. 2 on the tubular element 73, then a flat sealing means, i.e. in/on the surface 700 surrounding connection opening 70 may be installed.

It should be appreciated by those skilled in the art that various modifications and variations can be made in the present invention without departing from the scope and spirit of the invention. For example, features from one embodiment can be used on another embodiment to yield still a further embodiment. It is intended that the present invention include such modifications as come within the scope of the appended claims and their equivalents.

We claim:

1. An apparatus in an open-end spinning textile machine for the initiation of spinning of a thread, said apparatus comprising:

an opening device for opening individual fibers, and a spin rotor disposed to receive said individual fibers and spin said fibers into a thread;

said spin rotor disposed in a rotor housing which is connected to a controllable vacuum source;

a rotor cover removably attached to said rotor housing and covering said spin rotor;

a fiber feed conduit extending from said opening device to said spin rotor, said fiber feed conduit disposed at least in part in said rotor cover;

a connection opening path defined in said -rotor cover and opening into said fiber feed conduit;

a connection piece in pneumatic connection with said connection opening in said rotor cover at one end and selectively connectable at an opposite end thereof with a suction source during piecing to draw fiber flow in said fiber feed conduit through said connection opening and said connection piece; and a device disposed to seal said connection piece from said suction source during normal spinning operation of said open-end spinning machine.

2. The apparatus as in claim 1, wherein said connection piece has an entry aperture adjacent said connection piece with an inside cross-sectional area greater than an inside cross-sectional area of said connection piece.

3. The apparatus as in claim 1, wherein said connection piece has an inside diameter, that substantially continuously narrows in a direction towards said feed conduit.

4. The apparatus as in claim 1, wherein said feed conduit narrows in a direction towards said spin rotor, said connection opening in communication with said fiber feed conduit at a point of greatest cross-sectional area thereof.

5. The apparatus as in claim 1, wherein said connection opening forms an acute angle with an axis of said fiber feed conduit in a direction of fiber transport towards said spin rotor.

6. The apparatus as in claim 1, wherein said connection opening has a non-circular cross-sectional profile at a location where said connection opening is in communication with said fiber feed conduit, said non-circular profile having a greatest width extending essentially at a right angle to a direction of fiber transport through said fiber feed conduit.

7. The apparatus as in claim 6, wherein paid connection piece and said connection opening have a common axis that is essentially parallel to a spinning axis of said spin rotor.

8. A rotor cover for an open-end spinning machine wherein a spin rotor in a rotor housing receives fibers from an opening device and spins the fibers into a thread, said rotor cover comprising a feed conduit defined therethrough having one end configured for communication with said opening device and an opposite end configured for communication with said rotor housing.

9. The rotor cover as in claim 8, wherein said feed conduit has a narrowing cross-sectional area in a direction towards said spin rotor, said first end of said connection opening in communication with said feed conduit at a location of its greatest cross-sectional area.

10. The rotor cover as in claim 9, further comprising a contact surface disposed in a first vertical plane for affixing to an enclosure cover, said flat surface defining said opposite end of said connection opening being disposed in a second plane offset from and parallel to said first vertical plane.

11. The rotor cover as in claim 10, further comprising integral spacers formed on said rotor cover, said spacers defining said contact surface disposed in said first vertical plane.

12. The rotor cover as in claim 8, further comprising a flat surface defining said opposite end of said connection opening, said flat surface having a configuration for sealing contact with a sealing element of said connection piece.

13. The rotor cover as in claim 8, wherein said connection opening forms an acute angle with said feed conduit.

14. The rotor cover as in claim 8, wherein said first end of said connection piece has a non-circular cross-section with a greatest width extending at essentially a right angle to an axis of said feed conduit.

15. An apparatus in an open-end spinning textile machine for the initiation of spinning of a thread, said apparatus comprising:

an opening device for opening individual fibers, and a spin rotor disposed to receive said individual fibers and spin said fibers into a thread;

said spin rotor disposed in a rotor housing which is connected to a controllable vacuum source;

a rotor cover removably attached to said rotor housing and covering said spin rotor;

a fiber feed conduit extending from said opening device to said spin rotor, said fiber feed conduit disposed at least in part in said rotor cover;

a connection opening path defined in said rotor cover and opening into said fiber feed conduit;

a connection piece in pneumatic connection with said connection opening in said rotor cover at one end and connectable at an opposite end thereof with a suction source; and a break-away sealing connection between said connection piece and said rotor cover wherein said connection piece is removably and sealingly connected to said connection opening.

16. The apparatus as in claim 15, wherein said connection piece further comprises a chamber at said opposite end and a flap valve sealingly covering said chamber.

17. The apparatus as in claim 16, further comprising an enclosure adjacent said rotor cover, said chamber extending through and removably attached to said enclosure.

18. The apparatus as in claim 17, wherein said connection piece is carried by said enclosure at both said ends thereof, and further comprising a sealing element for sealing said connection piece to said rotor cover.

19. The apparatus as in claim 18, wherein said enclosure comprises a retaining plate adjacent said rotor cover, said sealing element removably carried by said retaining plate.

20. The apparatus as in claim 19, wherein said retaining plate comprises a first plate section bearing against said rotor cover and extending in a first plane, and a second plate section spaced from said first plane and extending in a plane essentially parallel to said first plane, said sealing device carrying said sealing device.

21. The apparatus as in claim 19, wherein said sealing element circumferentially sheathes an end portion of said connection piece and comprises a sealing surface that sealingly abuts against an opposite surface of said rotor cover defining said connection opening.

22. The apparatus as in claim 21, further comprising a break-away sealing connection between said sealing element and said retaining plate.

23. The apparatus as in claim 22, wherein said break-away sealing connection is formed integral with said retaining plate.

* * * * *

UNITED STATES PATENT AND TRADEMARK OFFICE

CERTIFICATE OF CORRECTION

PATENT NO. : 5,867,975

DATED : FEBRUARY 9, 1999

INVENTOR(S) : JOSEF BREITENHUBER ET AL.

It is certified that error appears in the above-identified patent and that said Letters Patent is hereby corrected as shown below:

Claims 7, column 10, line 51, delete "paid" and substitute therefor --said--.

Signed and Sealed this

Twenty-eighth Day of December, 1999

*Attest:*

Q. TODD DICKINSON

*Attesting Officer*

*Acting Commissioner of Patents and Trademarks*